United States Patent [19]

Strand et al.

[11] Patent Number: 4,467,845

[45] Date of Patent: Aug. 28, 1984

[54] METHOD AND MEANS FOR FILLING OF BULK MATERIAL IN FLEXIBLE CONTAINERS

[75] Inventors: Olaf Strand; Olav Skyllingstad, both of Porsgrunn, Norway

[73] Assignee: Norsk Hydro a.s., Oslo, Norway

[21] Appl. No.: 367,979

[22] Filed: Apr. 13, 1982

[30] Foreign Application Priority Data

Apr. 30, 1981 [NO] Norway ..... 811473

[51] Int. Cl.[3] ..... B65B 1/04

[52] U.S. Cl. ..... 141/10; 141/314; 53/459; 53/570

[58] Field of Search ..... 141/10, 67, 68, 114, 141/313-317, 83, 369-392, 250-284; 53/459, 469, 413, 570, 385, 134, 390

[56] References Cited

U.S. PATENT DOCUMENTS 3,215,173 11/1965 Rutherford ..... 141/314

FOREIGN PATENT DOCUMENTS 2022545 12/1979 United Kingdom .

*Primary Examiner*—Houston S. Bell, Jr.

*Attorney, Agent, or Firm*—Wenderoth, Lind & Ponack

[57] ABSTRACT

The invention relates to a method and means for filling of bulk material, especially fluidized material, is filled into a flexible container through a filling pipe while the container is hanging on a double, load carrying hook and simultaneously is resting against a supporting plate. Lifting loops of the container are stretched out during the entire filling operation. When filling of the container is completed, the hook and the supporting plate or plane are lowered simultaneously and the plane is also moved sideways, whereby the filling pipe is freed from the container. An external lever is then put into the lifting loop and the hook is opened, whereupon the container can be removed from the filling apparatus without having had any opportunity to tilt. The filling apparatus comprises a double hook with a lower section which can be opened while the hook is still in load carrying operation. The hook is connected to a holding device which preferably is movably connected to the plane for carrying the container. The plane can be moved both horizontally and vertically.

13 Claims, 3 Drawing Figures

METHOD AND MEANS FOR FILLING OF BULK MATERIAL IN FLEXIBLE CONTAINERS

BACKGROUND OF THE INVENTION

The present invention relates to a method and means for filling of bulk material, especially fluidized material, into flexible containers.

The method comprises filling of bulk material into a flexible container having lifting loops which are placed on a double, load carrying hook while the container bottom is placed on a carrying plane. The bulk material is filled into the container through a filling pipe comprising means for supplying air to blow up the container. The means for carrying out the method comprises a double, load carrying hook with holding devices. It further comprises a filling pipe for the bulk material and supply pipes for air and possibly also dust removing means. This filling apparatus also comprises a carrying plane against which the container bottom rests during the filling operation.

Filling of bulk material into flexible containers and making them ready for further transport can be carried out in different ways and applying different types of equipment adjusted to the actual purpose. Application of flexible containers for one special type of bulk material, i.e. fluidized material, has been highly desired. In this field there is an increasing demand for efficient solutions which make it possible to use flexible containers. During filling of fluidized material such as cement, special problems occur because the container just after having been filled is not stable. Such material gives special problems during the filling operation, but even more so during further transport and storage right after the filling operation. It has been found that it is very difficult to rapidly remove air, which gets into the container during the filling operation of the bulk material, from the container.

This implies that immediately after the filling operation, the container filled with fluidized material, behaves as if it were filled with a liquid. Therefore, the container cannot simply be disconnected from the filling apparatus and transported directly on a conveyer belt or left standing on a pallet, because it quite easily will tilt or sink to the ground.

Several methods have been attempted to solve these problems in order to arrive at efficient applications of flexible containers for fluidized material. One method used comprises filling the container while it is hanging on the forks of a truck and thereupon transport the container to storage immediately after the filling operation is completed.

Further there are known filling apparatuses for filling the container while it is hanging from its lifting loops (described in British patent application No. 2.022.545). This apparatus comprises a filling pipe which can be raised or lowered and which is arranged in a stationary or movable supporting frame. Hanging the container, including its inner bag, connecting and disconnecting this bag from the filling pipe, is however very complicated. Further it is quite labour consuming to release the lifting loops from the holding device and put them on to a hook or fork for transport of the container away from the filling apparatus. This apparatus is best suited for use in connection with a conveyer belt for further transport of the container. Accordingly it will be complicated to adjust this apparatus for economic filling of fluidized material.

Another filling apparatus is described in Norwegian Pat. No. 147,142, belonging to the applicant and having. According to this arrangement the bulk material is filled through a filling pipe which can be moved somewhat horizontally while the container is hanging by its lifting loops on a wide hook which can be moved both horizontally and vertically. The container bottom rests against a conveyer belt or a plate, and when the lifting loops are disconnected from the hook the container is standing without support on the conveyer belt by its whole weight. If this apparatus should be applied for filling fluidized material, there would be a great risk that the filled container would tilt as soon as it was disconnected from the hook. The lifting loops can not be released from the hook without lowering it and releasing the hook from its load. It has been found that this apparatus is not suited for filling of fluidized material.

Vibration of the container during or subsequent to filling in order to solve the associated with the fluidizing air was also studied by the inventors. However, this procedure did not turn out to be successful. Considering their own experience and knowledge of other people's experiences using this technique, the inventors found that the problem had to be solved in other ways.

The known technique, comprising hanging the container from the forks of a truck during filling and weighing, was further studied in order to find out more about its technical advantages. According to this method the container is transported subsequent to filling, while it is hanging from the forks of the truck, to a temporary storage site. Here the container is released from the forks, and the truck returns and a new container is put on the forks for filling. However, this operation requires at least two trucks in order to secure continuous application of the filling apparatus.

One variant of this technique comprises hanging the container during filling from a holding device which can be dismantled. The complete holding device, including the container hanging on it, is disconnected from the filling apparatus and transported by a truck to the temporary storage site, and there the holding device is manually released from the container and returned to the filling apparatus. Thus the need for several trucks is reduced, but continuous filling will then require several holding devices. The release of the container from such a device will also be labour consuming.

SUMMARY OF THE INVENTION

The main object of the present invention is to provide a method and means which made it possible to use flexible containers for fluidized material, and where the filling operation and making the filled container ready for further transport and storage can be carried out in a simple and safe way without needing large investments, and still having a system with a high capacity.

A further object is to construct new means and arrive at a system which is useable for filling both fluidized and ordinary bulk material.

In the beginning the inventors concentrated their efforts on solving the problems in connection with fluidized material. It was noted that if the filled container was allowed to stay for some time the air in the fluidized material would seep out of the container, and then it could be handled in the same way as containers filled with ordinary bulk material. Within these limits it was then a problem to find a method for filling and making the container ready for transport to a preliminary storage site without blocking the filling apparatus or the transport means for longer time than that necessary for carrying out the functions for which they were provided.

When a truck, for instance, was used for removing the container from the filling apparatus, the truck should only be needed for the time necessary to run to and from the storage site. Further, it was desired that the container should be moved while it was kept in an upright position in the filling apparatus and that it was moved from it and placed at the storage site in a safe manner without risking that the container tilted during these operations. It was found that it would be an advantage if the container could be hanging in a hook during the filling operation. The hooks applied in known apparatuses in this field did however turn out to be unsuitable for this purpose, because as soon as the lifting loops were released from such a hook, the filled container would fall down and overturn even if its bottom was resting on a plane during the filling operation.

During further development it was found that a double hook could be applicable if it comprised two connected parts and if two axes of rotation were applied. Thus, there is provided a hook which could be opened while it was in load carrying operation and which was suitable for transferring the lifting loops to a carrying lever. It was found that by means of such a hook another hook or lever could be put into the lifting loops before the special hook was opened and the container could be lifted away from the filling apparatus as soon as such hook was opened.

Before the container could be removed from the filing apparatus, it should be released from the filling pipe. It was found that this operation could be carried out in a simple manner if the container was placed on a carrying plane which could be lowered and also moved away from the filling pipe.

If the above mentioned solutions were put together for forming a complete filling means and method, one became able to fulfil the objects of the invention.

Such means proved to be very simple for filling of ordinary bulk material also.

The characterizing features of the method according to the invention are that the container is filled in such a position that a substantial part of its weight is carried by a load carrying plane while the remaining weight is carried by the lifting loops and the hook, whereby the loops are kept tight during the filling operation, and that subsequent to filling the hook is lowered and at the same time the plane is lowered and moved sideways. Thereby, the filling pipe is released from the container, whereupon an external lever is put into the lifting loop, and the hook is then opened and raised such that the container thereupon can be lifted away from the filling apparatus.

A further feature of the method comprises filling while the hook is in such a position above the carrying plane that the container lifting loops are kept tight and form a hoop like opening beneath the hook and that before the hook is opened an external lever is put into this opening.

The main characterizing feature of the means according to the invention comprises the design of the hook such that it can be released from the flexible container lifting loops while it is carrying weight, and that the hook is connected to a bar or the like such that it is at least vertically movable and that the hook preferably is connected to a carrying plane which can be moved both horizontally and vertically.

The hook can be connected to the bar by means of a member vertically movably connected to another member which is fastened to the carrying plane. Such another member is hinged to a frame such that when it is lowered it is also moved horizontally away from the filling pipe.

The carrying plane is moved and kept in desired position by means of a hydraulic cylinder which possibly is connected to a weighing cell.

The characterizing feature of the most preferred construction of this apparatus implies that a hook comprises two shafts or arms having upper ends revolvingly fastened by pins to a frame and lower ends fastened to two other shafts which can be in the form of a loop hanging revolvingly from a bracket when the hook is in closed position.

The first pair of shafts is fastened to the other pair by means of pins in one of the pair of the shafts. The hook can be opened by displacing the lower part of the first stated shafts, relatively to the lower ends of the two other shafts.

In this special design of the hook the pins are fastened to the shafts which are in the form of a loop, and the two other shafts are connected to each other by two connected beams which by a joint are connected to a cylinder rod for vertical movement of the joint and thereby making it possible to release or connect the two pairs of shafts at their lower ends when the hook is in closed position.

BRIEF DESCRIPTION OF THE DRAWINGS

A further explanation of the invention will be given below in connection with the description of a filling apparatus comprising a double hook according to the invention, with reference to the accompanying drawings, wherein.

DETAILED DESCRIPTION OF THE INVENTION

Figure 1:
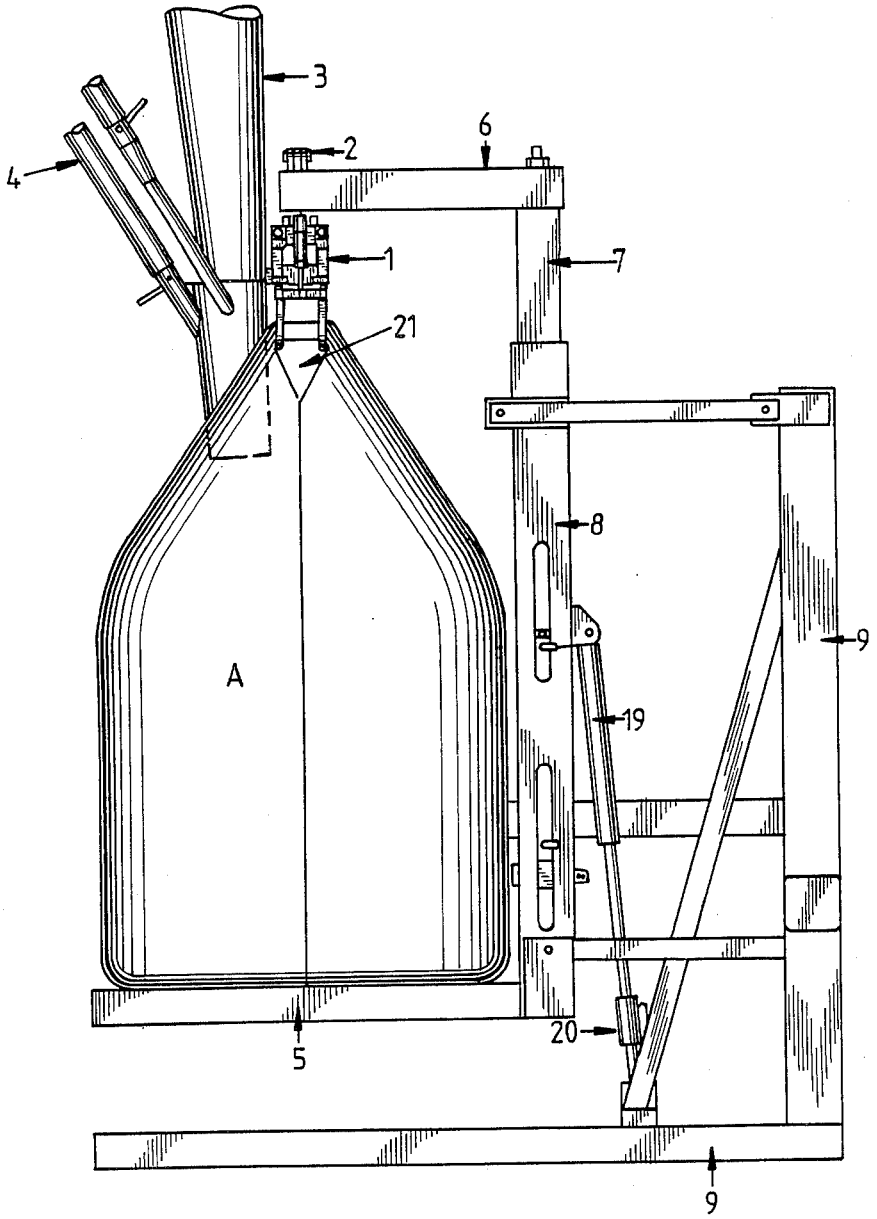
FIG. 1 is an elevation view of a filling apparatus, including a double hook, during filling of a flexible container.

FIG. 1 shows a filling apparatus while fluidized material is filled into a flexible container (A), which usually is equipped with an airtight inner bag and is here shown drawn on to a filling pipe (3). Before filling of bulk material, the container (A) is blown up by air supplied through a pipe (4) while the container is standing on a carrying plane or generally planar supporting member (5) and hanging on a hook (1) which is connected to a bar (6) by means of a holding device (2). The lifting loops of the container (A) form a loop formed opening (21) below the hook (1). The bar (6) is connected to a first member (7) which is telescopically movable within a second member (8) which is connected to the carrying plane (5). The first member (7) and thereby the bar (6) and the hook (1) can be raised or lowered by means of a hydraulic cylinder (not shown in the drawings), but also can be locked in a fixed position and thereby raised or lowered when the plane (5) is raised or lowered. The carrying plane (5) is hinged to a frame (9) and also is connected thereto by a hydraulic cylinder (19) fastened to the frame (9) and the second member (8).

As soon as the filling of the bulk material is completed, the carrying plane (5) is lowered at the same time as it is moved sideways because of the hinge connection (toward the right as viewed in FIG. 1). The container is thereby freed from the filling pipe (3). A weighing cell (20) can be arranged between the hydraulic cylinder (19) and the frame (9).

Figure 2:
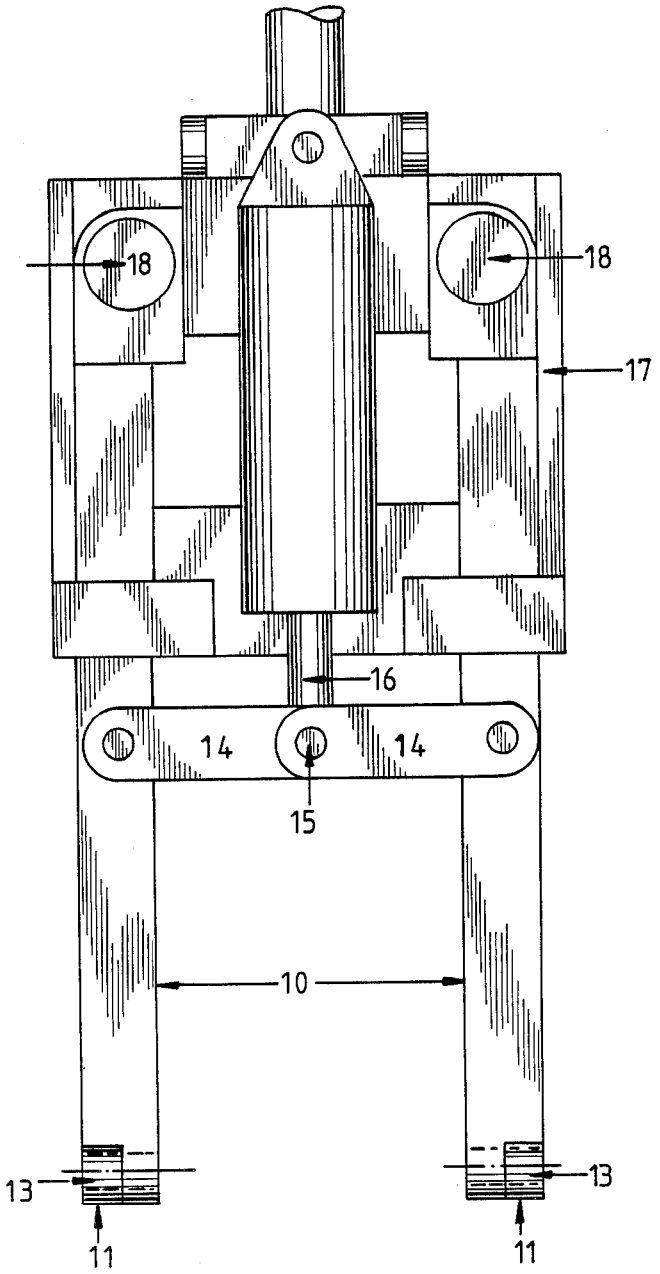
FIG. 2 is a front view of a double hook.

FIG. 2 shows the double hook (1) in detail. It has two shafts or arms (10) revolvingly fastened to a frame (17) by means of first pins (18). When the hook is carrying a load and when the lifting loops of the container are put on the hook, the shafts (10) have their lower ends connected to two other shafts or arms (11) by means of second pins (13) which are fastened to one of the pairs of shafts. The two shafts (10) are connected by two beams (14) joined at a junction (15), to which also is coupled a cylinder rod (16). In order to open the hook while it is loaded, the rod (16) is pressed downwards, whereby the shafts (10) are rotated turned around the pins (18) and their lower ends are moved toward each other and thereby released from the pins (13).

Figure 3:
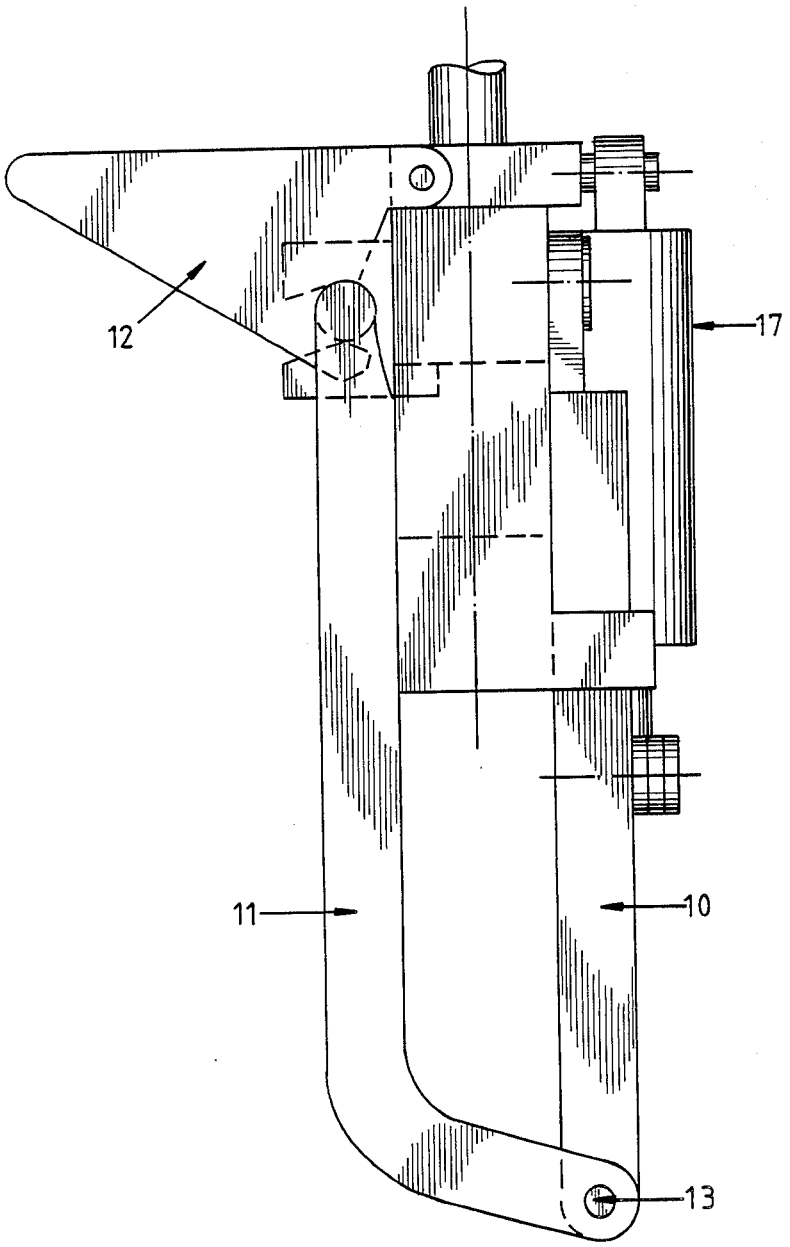
FIG. 3 is a side view of the double hook of FIG. 2.

In FIG. 3 it is clearly shown how the pair of shafts (10) and (11) are connected by the pins (13). The shafts (11) are vertical extensions of a loop and hand revolvingly in a bracket (12) when the hook (1) is closed. When the shafts (10) are disconnected from the shafts (11), the respective pairs of shafts hang from the frame (17) and the bracket (12).

Carrying out the method of the invention by use of the above described apparatus can be performed in the following manner: In this example filling of cement into a flexible container having an inner bag and two integral lifting loops is described.

The hook is first opened by raising the bracket (12) such that the shafts (11) are lowered and turn around the pins (13), and one of the lifting loops is then put on to the hook. The opening of the inner bag is then put on the filling pipe (3), whereupon the other lifting loop is fastened to the hook (1) which is then closed. The container (A) is blown up by air and stand upright as shown on FIG. 1, and it is ready for being filled.

During the filling operation the lifting loops are tightened, and because a double hook is used there will be formed a loop-formed opening (21) directly beneath the hook. The two lifting bags are preferably fastened together by means of a tape or the like between the connected pair of arms of the hook, thereby forming a relatively rigid loop opening. The container is released from the filling pipe (3) by lowering and moving sideways the plane (5) while the container still is hanging on the hook (1). Before the container is removed from the apparatus, a gross weighing of the filled container is carried out by means of the weighing cell (20). An external lever connected to a truck is then inserted through the opening (21). The container (A) is then simultaniously hanging on the external lever and the hook (1), which now can be released from the lifting loops without risking tilting of the container. Having opened the hook and released it from the lifting loops, the container can be lifted up from the plane (5) by means of the lever of the truck and transported directly to a storage site. Here the container is carefully lowered down, and the lever is removed from the loop-formed opening without any help from an extra operator. The truck then returns to the filling apparatus, where a new container in the meantime has been filled and made ready for removal.

The method and means according to the invention form a system which makes it possible to use flexible containers in an efficient way for fluidized material. The filling apparatus has large capacity and needs only one truck for transport of the filled container to the storage site where the fluidizing air can be removed. The container can be released from the filling apparatus, transported to the storage site and placed there safely, whereby capsizing of the container is avoided while it is unstable because its content is still fluidized. Making the container ready for filling and releasing it from the filling apparatus is simple and not labour consuming when the apparatus according to the invention is used. The simple gross weighing of the container has also proved to be of great importance.

The method and means are also well suited for filling of ordinary bulk material.

We claim:

1. A method of filling bulk material into a flexible container of the type having at least one upper lifting loop by which the container may be lifted, said method comprising:

supporting said lifting loop by a load carrying double hook, while supporting the bottom of said container by a generally planar supporting member;

introducing air into the interior of said container, thereby blowing up said container;

filling bulk material into said interior of said container, while supporting a substantial portion of the weight thereof by said hook, thereby maintaining said lifting loop taunt during filling;

upon completion of said filling, simultaneously lowering said hook and said supporting member, while moving said supporting member laterally;

inserting an external lever through said lifting loop; and opening and removing said hook, whereby said lifting loop is supported by said external lever.

2. A method as claimed in claim 1, further comprising removing said filled container from said supporting member by means of said external lever, and thereby carrying said filled container to a storage location.

3. A method as claimed in claim 1, wherein said introducing and said filling result in said bulk material being fluidized in said container.

4. A method as claimed in claim 1, comprising introducing said air and filling said bulk material into said interior of said container by means of a filling pipe extending through a filling opening in the top of said flexible container, and said lowering and said moving laterally move said filled container away from said filling pipe.

5. A method as claimed in claim 1, wherein during said filling said lifting loop is tensioned tightly, thereby forming an opening therethrough for receipt of said external lever.

6. An apparatus for filling bulk material into a flexible container of the type having at least one upper lifting loop by which the container may be lifted, said apparatus comprising:

means for introducing air into the interior of the container, thereby blowing up the container, and for filling bulk material into the interior of the container;

a generally planar supporting member for supporting the bottom of the container during filling;

load carrying double hook means for engaging the lifting loop of the container and for supporting a substantial portion of the weight of the container during filling thereof, thereby maintaining the lifting loop taunt during filling; and means for, upon completion of filling of the container, simultaneously lowering said hook means and said supporting member while moving said supporting member laterally thereby moving the filled container away from said filling means, whereafter an external lever may be inserted through the lifting loop and said hook means may be released from engagement with the lifting loop and removed, such that the lifting loop then is supported by the external lever.

7. An appartus as claimed in claim 6, wherein said lowering and moving means comprises a bar supporting said hook, means for moving said bar vertically and for connecting said bar to said supporting member, and means for moving said supporting member vertically and horizontally.

8. An apparatus as claimed in claim 7, wherein said bar moving means comprises a first member connected to said bar and vertically telescopically movably mounted in a second member which is fastened to said supporting member, and a frame hinged to said supporting member in a manner such that vertical movement thereof will result in simultaneous horizontal movement thereof.

9. An apparatus as claimed in claim 8, further comprising a hydraulic piston-cylinder assembly connected between said frame and said second member.

10. An apparatus as claimed in claim 9, further comprising a weighing cell between said assembly and said frame.

11. An apparatus as claimed in claim 6, wherein said hook means comprises a frame, a pair of first arms having upper ends pivotally connected to said frame by means of first pins and lower ends, a bracket pivotally mounted to said frame for movement between hook open and hook closed positions, a pair of second arms having upper ends revolvingly supported by said bracket when in said hook closed position thereof and lower ends extending toward said lower ends of said first arms, second pins pivotally connecting said lower ends of said first arms to lower ends of respective said second arms, and means for pivotting said first arms about said first pins to move said lower ends of said first arms away from respective lower ends of said second arms to a hook release position releasing said connection by said second pins.

12. An apparatus as claimed in claim 11, wherein said pivotting means comprises a pair of beams pivotally connected to respective said first arms, and a piston-cylinder assembly mounted on said frame and having a vertical piston rod pivotally connected to said pair of beams at a connecting joint, such that vertical movement of said joint by said piston rod results in pivotting of said first arms about said first pins.

13. An apparatus as claimed in claim 6, wherein said introducing and filling means comprises a filling pipe adapted to extend through a filling opening in the top of the container, and an air supply pipe extending through said filling pipe.

* * * * *